US006139365A

United States Patent [19]

Lok

[11] Patent Number: 6,139,365

[45] Date of Patent: Oct. 31, 2000

[54] CENTRONIC CONNECTOR ASSEMBLY

[75] Inventor: Gordon Lok, Montebello, Calif.

[73] Assignee: Hon Hai Precision Ind. Co., Ltd., Taipei Hsien, Taiwan

[21] Appl. No.: 09/190,392

[22] Filed: Nov. 10, 1998

[51] Int. Cl.[7] ..... H01R 13/648; H01R 9/09

[52] U.S. Cl. ..... 439/607; 439/76.1

[58] Field of Search ..... 439/607, 610, 439/76.1, 497, 701, 352–358

[56] References Cited

U.S. PATENT DOCUMENTS 5,603,634 2/1997 Ichikawa et al. ..... 439/404

5,941,725 8/1999 Brennan et al. ..... 439/357

*Primary Examiner*—Khiem Nguyen
*Assistant Examiner*—Son V. Nguyen
*Attorney, Agent, or Firm*—Wei Te Chung

[57] ABSTRACT

A centronic connector assembly comprises a lower cover and an upper cover assembled to the lower cover defining a receiving space therebetween. A lower EMI shield and an upper EMI shield are assembled in the receiving space. One of the EMI shields includes a mount on a wall thereof. A centronic connector including a housing having front and rear faces is assembled to the covers. A printed circuit board is assembled to the rear face of the connector at a first end and a second end opposite the first end is securely supported by the mount.

3 Claims, 4 Drawing Sheets

CENTRONIC CONNECTOR ASSEMBLY

FIELD OF THE INVENTION

The present invention relates to a centronic connector assembly, and more particularly to a centronic connector assembly for use with USB cable.

DESCRIPTION OF PRIOR ART

A USB cable (also referred to as a "Smart Cable"), utilizing hardware and software, provides intelligent and transparent protocol conversion between a Universal Serial Bus on the PC side and IEEE 1284 Parallel on the printer side. The smart cable allows any Windows PC with a USB port to print to any parallel printer.

A conventional USB cable assembly includes a centronic connector 10, and a USB connector 11 connected to the centronic connector 10 by a cable 12, see FIG. 1. The centronic connector 10 includes housing having a front face and a rear face. A peripheral wall extends from the front face defining a cavity therebetween. An island is formed within the cavity. The island defines a series of terminal recesses exposed to the rear face. A plurality of terminals are assembled in the terminal recesses. A printed circuit board having electrical components mounted thereon is assembled to a rear portion of the housing. An EMI shield encloses the printed circuit board to eliminate EMI interference. Plastic upper and lower covers are assembled to the EMI shield. The assembly defines a window for extension of the centronic portion, and an opening for receiving of the cable. However, after the printed circuit board is assembled to the housing, a distant edge thereof is suspended thereof without any support from the EMI shield or plastic cover. Since the housing of the centronic connector is sandwiched between the covers, the cantilevered printed circuit board tends to deflect when an excessive load is applied, i.e. when conductive wires from the cable are soldered to conductors of the printed circuit board. If the conductors of the printed circuit board inadequately contact with the EMI shield, signal transmission will be adversely affected.

SUMMARY OF THE INVENTION

An objective of this invention is to provide a centronic connector assembly in which an EMI shield is provided with a mount to support a free end of a printed circuit board thereby eliminating inadequate contact between conductors of the printed circuit board and the EMI shield.

In order to achieve the objective set forth, a centronic connector assembly comprises a lower cover and an upper cover assembled to the lower cover defining a receiving space therebetween. A lower EMI shield and an upper EMI shield are assembled in the receiving space. One of the EMI shields includes a mount on a wall thereof. A centronic connector including a housing having front and rear faces is assembled to the covers. A printed circuit board is assembled to the rear face of the connector at a first end thereof and a second end opposite the first end is securely supported by the mount.

These and additional objects, features, and advantages of the present invention will become apparent after reading the following detailed description of the preferred embodiments of the invention taken in conjunction with the appended drawings.

DETAILED DESCRIPTION OF PREFERRED EMBODIMENT

Figure 1:
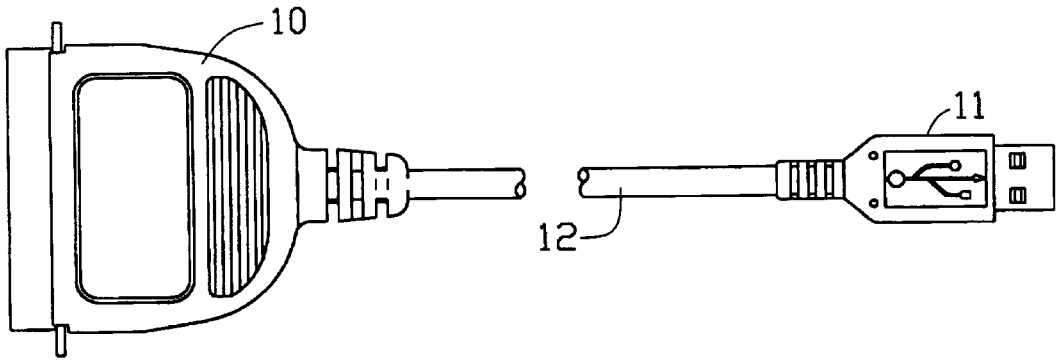
FIG. 1 (PRIOR ART)
FIG. 1 is a top plan view of a prior art smart cable used between a PC and a printer.
Figure 2B:
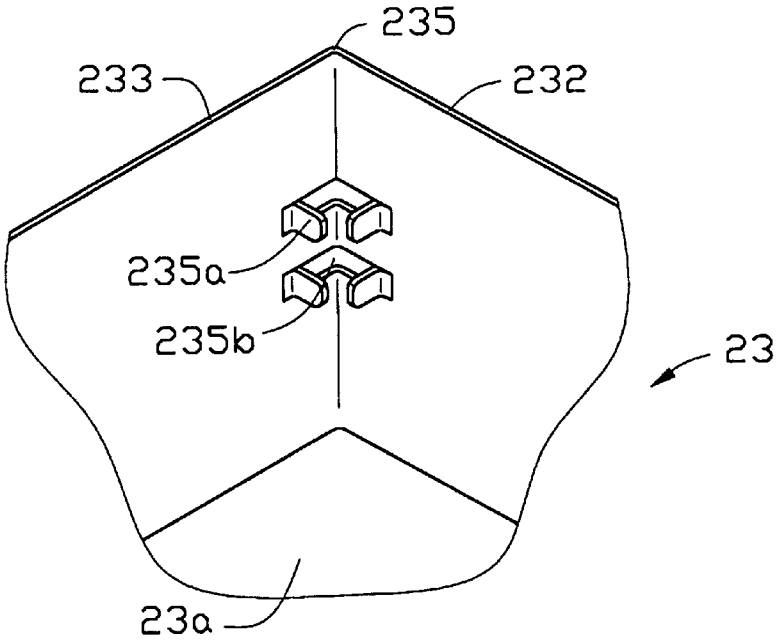
FIG. 2B is an enlarged view of a corner of an EMI shield of FIG. 2A.
Figure 2A:
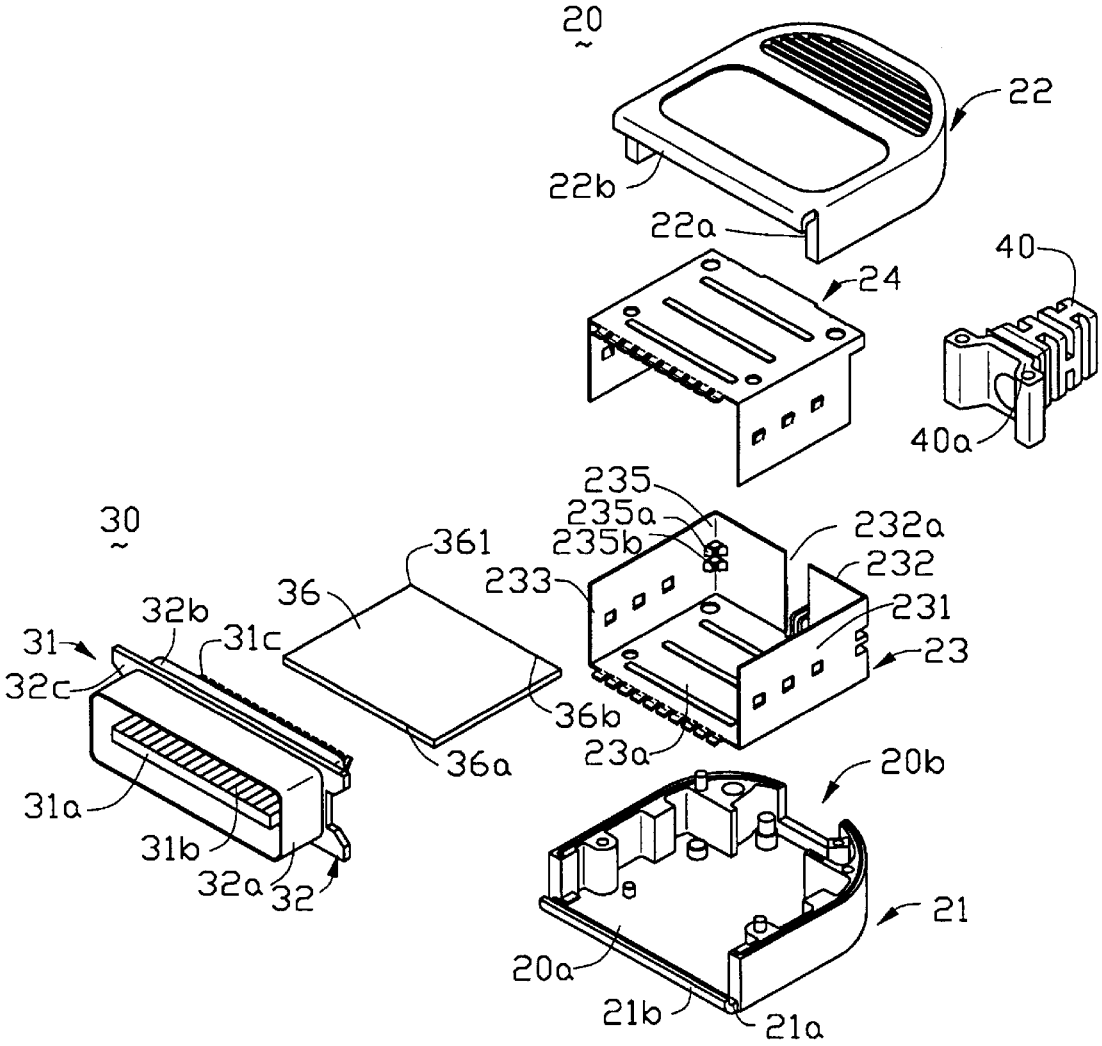
FIG. 2A is an exploded view of a centronic connector assembly in accordance with the present invention without showing the respective wires extending out of the corresponding cable.
Figure 3:
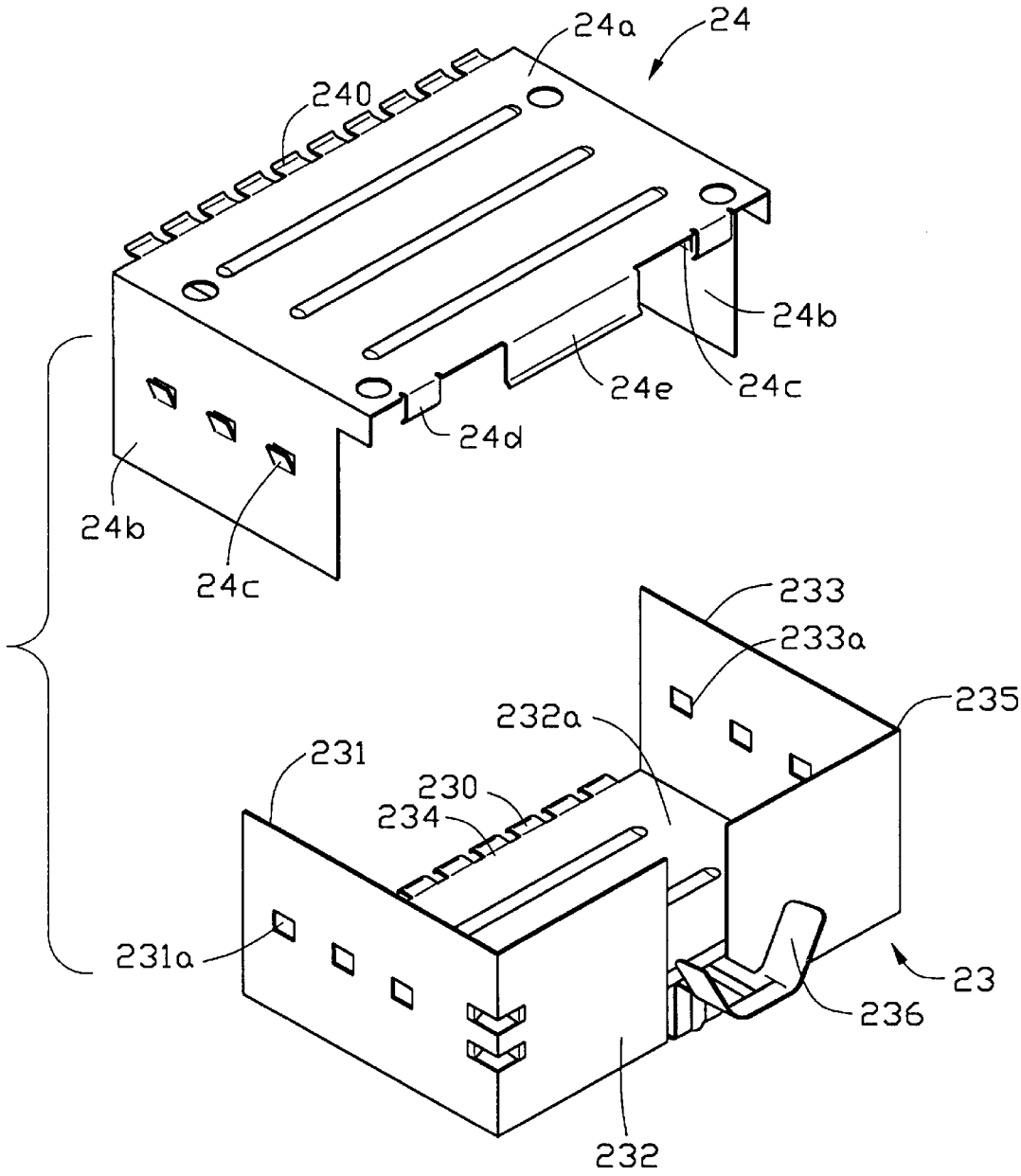
FIG. 3 is a perspective view of the EMI shield in accordance with the present invention.

Referring to FIG. 2A, 2B and 3, a centronic connector assembly 20 in accordance with the present invention generally comprises a lower cover 21 and an upper cover 22 assembled to the lower cover 2 defining a receiving space (not labeled) therebetween. An elongate opening 20*a* is defined in said covers 21, 22 at an end thereof, and an outlet 20*b* opposite the elongate opening 20*a* is defined in another end thereof. A lower EMI shield 23 is assembled to the lower cover 21. The lower EMI shield 23 has a bottom 23*a* having three wall portions 231, 232, 233 extending therefrom and defining two corners 234, 235 between two adjacent wall portions 231, 232, and 232, 233. The wall portion 232 defines a slot 232*a* therein for the extension of conductive wires therethrough (not shown).

The corner 235 forms two pairs of ribs 235*a* projecting inward thereby defining a retention slot 235*b* therebetween each pair of ribs 235*a*. By this arrangement, a rear corner 361 of a printed circuit board 36 can be securely supported therein. The corner 234 has the same configuration as the corner 235 thus no further description is given. A clamp 236 is arranged behind the slot 232*a* tor electrically contacting with a metal braid of the cable. By this arrangement. a grounding path is established between the cable and the centronic connector 20. The wall portions 231,233 define openings 231*a*, 233*a*. An upper EMI shield 24 is assembled to the lower EMI shield 21. The upper EMI shield 24 has a pair of wall portions 24*b* extending from transverse ends of the base 24*a* thereof. Each wall portion 24*b* includes clips 24*c* engaged with the corresponding openings 23 la, 233*a*. By this arrangement, a complete grounding path can be established between the upper and lower EMI shields 24, 23. The upper EMI shield 24 forms flaps 24*d*, 24*e* extending from a transverse side thereof for engaging with the wall portion 232. The upper and lower EMI shields 23, 24 form a plurality of contact tabs 230, 240 for grounding with a metal portion of a centronic connector 30.

The centronic connector 30 includes a housing 31 forming a forwardly extending island 31*a*. A plurality of terminals 31*b* are assembled in the housing 31. Tail portions 31*c* of the terminals 31*b* define a retaining slot (not labeled) for retention of a front edge 36*a* of the printed circuit board 36. The printed circuit board 36 is formed with conductors (not labeled) for electrically contacting with the tail portions 31*c*. A rear edge 36*b* of the printed circuit board 36 is also formed with conductors (not shown) for soldering to conductive wires. The housing 31 includes a metal shroud 32 having a front portion 32*a* for enclosing the island 31 a and a rear portion 32*b* for enclosing the tail portions 31*c*. The metal shroud 32 further includes a flange 32*c* which is received in retaining slots 21*a*, 22*a* defined by dam portions 21*b*, 22*b*, respectively.

A strain relief 40 is assembled to the lower cover 21. The strain relief 40 defines a passage 40*a* for extension of the cable therethrough. After the upper and lower covers 21, 22 are assembled and welded together through ultrasonic fusing, the strain relief 40 can be fixedly held therein. This prevents excess force from being applied to connections between the conductive wires and conductors on a printed circuit board (not shown).

Figure 4:
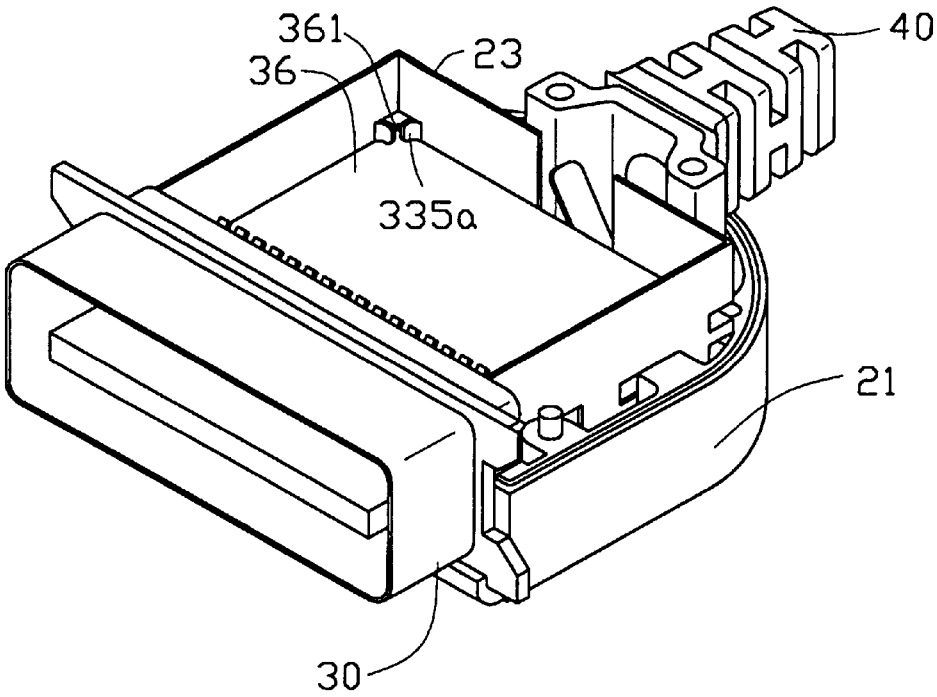
FIG. 4 is an assembled view of the centronic connector with an upper cover and an upper EMI shield removed therefrom.
Figure 5:
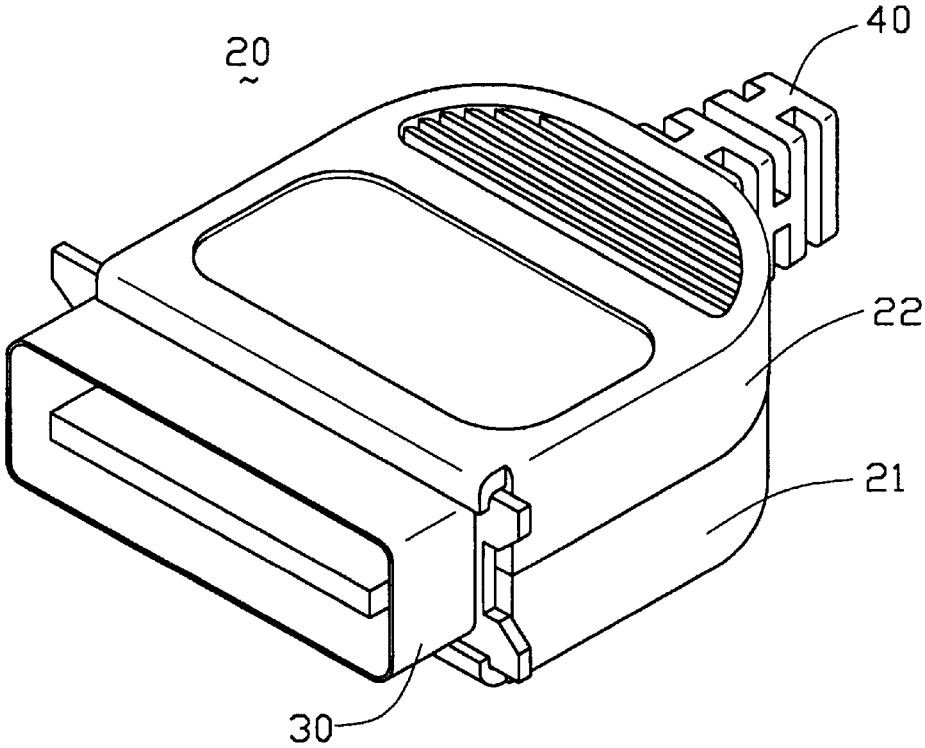
FIG. 5 is an assembled view of FIG. 2A.

In FIG. 4, the lower EMI shield 23 is assembled to the lower cover 21 and the corner 361 of the printed circuit board 36 is securely supported between the two pairs of ribs 235*a*. Since the front edge 36*a* of the printed circuit board 36 is supported between the slot defined between the tail portions 32*b*, the printed circuit board 36 is firmly held therein. FIG. 5 shows complete assembly of the centronic connector 20 whereby the upper cover 22 is securely attached to the lower cover 21.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. A centronic connector assembly, comprising:

a lower cover;

an upper cover assembled to said lower cover defining a receiving space therebetween, an elongate opening being defined in said assembled lower and upper covers at an end thereof, and an outlet opposite said elongate opening being defined in another end thereof;

a lower EMI shield being assembled to said lower cover;

an upper EMI shield being assembled to said lower EMI shield, one of said lower and upper EMI shields being provided with two pairs of parallel ribs in opposite rear corners thereof whereby one retention slot is defined between each pair of parallel ribs;

a centronic connector being assembled to said covers, said centronic connector including a housing having front and rear faces, a metal shroud extending from said front face defining a cavity therebetween, the housing forming an island extending forward into said cavity, a retaining slot defined at a rear face of the island, a plurality of passageways being defined in the housing and each passageway having a terminal mounted therein; and a front edge of a printed circuit board being inserted into said retaining slot, wherein a rear edge of the printed circuit board opposite to said front edge has opposite corners securely supported by the retention slots of the one of the lower and upper EMI shields.

2. A cable connector assembly comprising:

a connector with terminal received therein;

a printed circuit board attached at a front edge to a rear face of said connector;

a shield assembly enclosing said printed circuit board;

a cover assembly enclosing said shield assembly; wherein a pair of ribs is provided in each of opposite rear comers of the shield assembly to define a retention slot therebetween whereby two opposite comers of a rear edge of the printed circuit board opposite to the front edge is securely supported by said retention slots of said shield assembly;

said shield assembly includes a lower shield and an upper shield wherein said ribs are formed on one of said lower shield and said upper shield.

3. The connector as recited in claim 2, wherein said cover assembly includes an upper cover and a lower cover.

* * * * *